US006765534B2

(12) United States Patent
Kwon et al.

(10) Patent No.: US 6,765,534 B2
(45) Date of Patent: Jul. 20, 2004

(54) MECHANICAL BEAM STEERING ANTENNA AND FABRICATING METHOD THEREOF

(75) Inventors: Young-Woo Kwon, Sungnam (KR); Chang-Yul Cheon, Seoul (KR); Yong-Kweon Kim, Seoul (KR); Seung-Hyun Song, Seoul (KR); Chang-Wook Baek, Anyang (KR); Yang-Soo Lee, Seoul (KR)

(73) Assignee: Seoul National University, Seoul (KR)

( * ) Notice: Subject to any disclaimer, the term of this patent is extended or adjusted under 35 U.S.C. 154(b) by 200 days.

(21) Appl. No.: 10/018,280

(22) PCT Filed: Aug. 16, 2001

(86) PCT No.: PCT/KR01/01391

§ 371 (c)(1),
(2), (4) Date: Dec. 14, 2001

(87) PCT Pub. No.: WO02/15327

PCT Pub. Date: Feb. 21, 2002

(65) Prior Publication Data

US 2003/0160722 A1 Aug. 28, 2003

(30) Foreign Application Priority Data

Aug. 17, 2000 (KR) ..... 2000-47534

(51) Int. Cl.[7] ..... H01Q 1/38

(52) U.S. Cl. ..... 343/700 MS; 343/765; 29/600

(58) Field of Search ..... 343/700 MS, 757, 343/765, 882; 29/600

(56) References Cited

U.S. PATENT DOCUMENTS 4,728,962 A * 3/1988 Kitsuda et al. ..... 343/872
5,359,337 A * 10/1994 Egushi ..... 343/700 MS

* cited by examiner

*Primary Examiner*—Michael C. Wimer
(74) *Attorney, Agent, or Firm*—Marshall, Gerstein & Borun LLP

(57) ABSTRACT

The present invention is concerning an element antenna to construct an efficient antenna system, which is able to control mechanical movement of micro-strip patch antenna and to control electrical phase of signal. The movement of an element antenna is come from movement of a platform on which the element antenna is formed. The platform is made of dielectric material and able to move independently from base. The element antenna can be controlled to any direction. An antenna patch has magnetic material layer such as nickel on the backside. The antenna patch is driven by magnetic force.

5 Claims, 5 Drawing Sheets

MECHANICAL BEAM STEERING ANTENNA AND FABRICATING METHOD THEREOF

BACKGROUND OF THE INVENTION (a) Field of the Invention

The present invention relates to an array antenna system.

(b) Description of the Related Art

Conventional array antenna systems are used to send beams in desired directions, that is, in the directions to which targets are located. The directions of the beams of the array antenna are steered by controlling electrical phase differences between respective antennas that form an array. This technique enables antenna beams to be sent in a direction where a target object is located without rotating the antenna, or enables antenna beams to be received from that direction so that the direction of the target that sends or reflects the signals can be effectively caught.

FIG. 1 shows an array antenna system where "d" represents a distance between the antennas, "ϕ" represents an electric phase of the antennas, and "θ" represents the direction of the beams to be sent.

However, this array antenna system is problematic in that the performance of the corresponding antenna is reduced when the direction of the beams digresses from the central axis of the individual antennas. The array antenna's radiation pattern is represented by a multiplication of the respective antennas' radiation patterns by an array factor. The array factor can only be adjusted by using electrical phase differences between the antennas. When the direction of the beams digress from of the central axis, the amount of the energy radiating from each antenna is reduced compared to the that of the maximum energy, and the array factor is multiplied to the energy so that the antenna performance is reduced.

To solve this, antennas are pre-configured to decline in various directions, and antennas that decline in the desired direction of the beams are selected using a switch so that the array antenna system, including the antennas can be used. However, this method increases cost because of the increase of the number of the antennas, the magnitude of the array antenna is increased, and also, limited beam angles can be selected.

SUMMARY OF THE INVENTION

It is an object of the present invention to provide an antenna for building an array antenna system for obtaining uniform maximum performance in all beam directions by overcoming the problem that lowers the performance of a conventional array system when the angle between the beam direction of the array system and the central axis of each unit antenna is increased.

It is another object of the present invention to provide a small-size antenna for enabling fast mechanical motion and minute control of the driving angle.

It is still another object of the present invention to mass manufacture antenna array systems capable of mechanical operation through a batch process and integrate antennas and drivers.

In one aspect of the present invention, an antenna device comprises: an antenna; a first rotation shaft for enabling angular displacements of the antenna in the first direction; a second rotation shaft for enabling angular displacements of the antenna in the second direction independent from the angular displacements of the antenna in the first direction; a platform for supporting the antenna; an internal frame connected to the platform through the first rotation shaft; an external frame connected to the platform through the second rotation shaft; a ground plane formed on a surface opposite to a surface on which the antenna of the platform is formed; a first conductive line connected to the antenna; a second conductive line connected to the ground plane; and a driver for mechanically displacing the platform and the internal frame using electromagnetic force.

In another aspect of the present invention, a method for manufacturing an antenna device comprises: attaching a silicon substrate to a glass substrate; processing the glass substrate to form a displacement space; forming a ground plane on the silicon substrate; forming a dielectric layer on the ground plane; forming an antenna on the dielectric layer; patterning the dielectric layer to form a platform, an internal frame, an external frame and a hinge; and patterning the silicon substrate to separate it into a platform unit, an internal frame unit and an external frame unit.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 2(*b*) shows performance in the case of using an array antenna that utilizes antennas according to a preferred embodiment of the present invention;

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
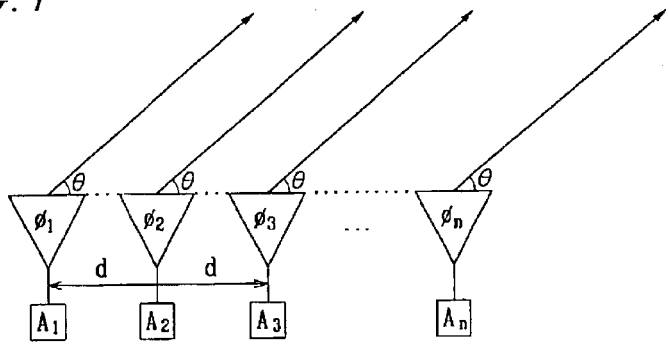
FIG. 1 shows an array antenna system.
Figure 2A:
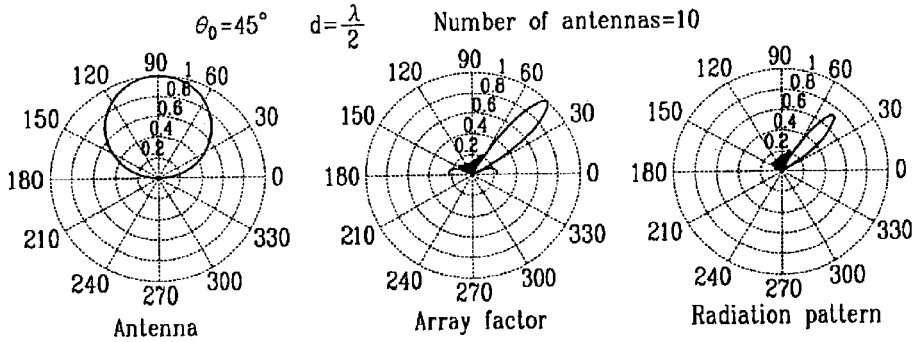
FIG. 2(*a*) shows performance in the case of using a conventional array antenna.
Figure 2B:
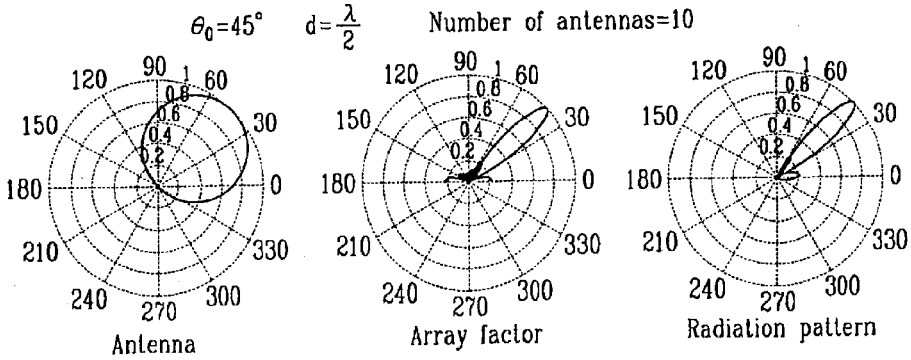

FIG. 2(*a*) shows each antenna's pattern, array factor and radiation pattern in the case of using a conventional array antenna system. FIG. 2(*b*) shows simulation results of each antenna's pattern, array factor and final radiation pattern in the case of configuring an array antenna using mechanically movable antennas, where the gap between the antennas is defined to be ½ wavelength, and the beam direction is set to be 45 degrees from the direction perpendicular to the antenna array if the number of the antennas is set to be '10.'

It is found from the simulation that the radiation pattern of FIG. 2(*b*) is better than that of FIG. 2(*a*). It shows that the case of mechanically moving the antenna so that the radiation side of the antenna is directed to the direction to which the beams will be sent has better beam characteristics.

Figure 3:
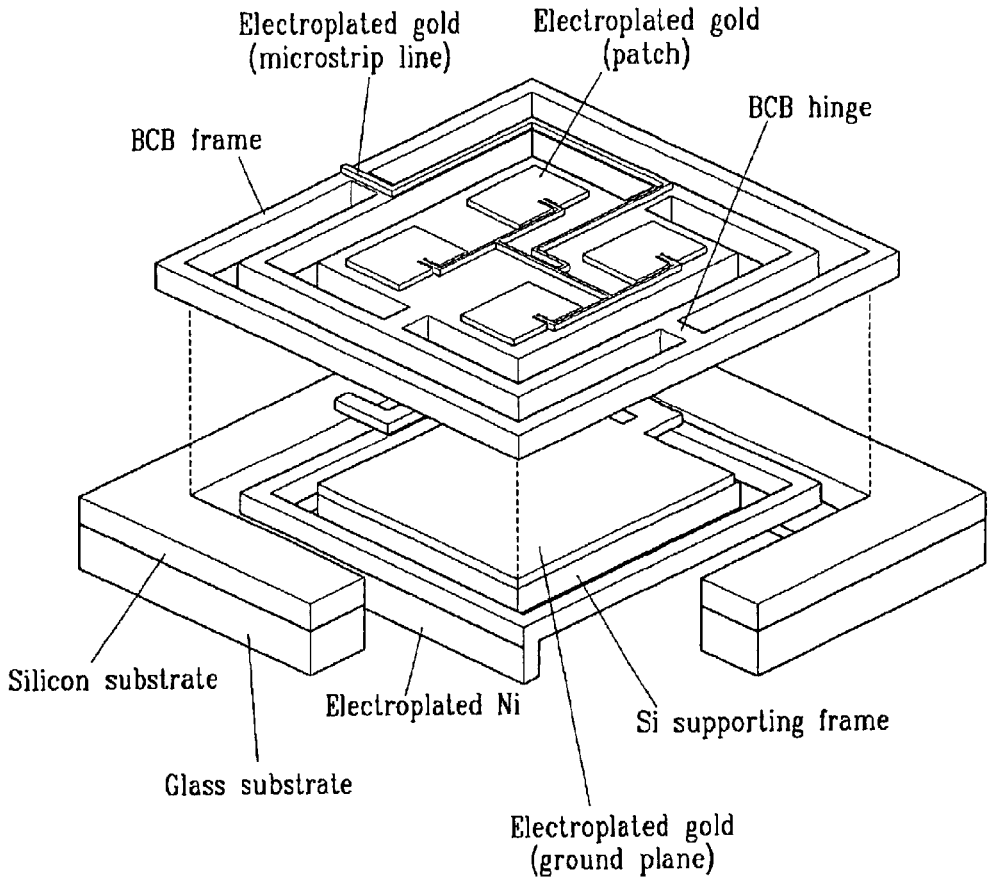
FIG. 3 shows a configuration of a beam steering antenna capable of mechanical movements.
Figure 4A:
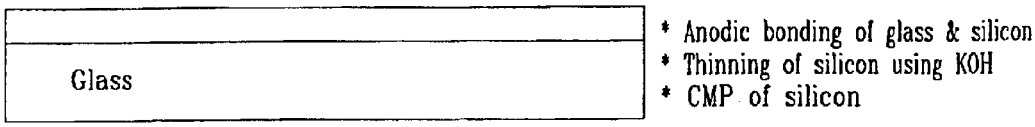
FIG. 4 shows a process for manufacturing a mechanical beam steering antenna according to a preferred embodiment of the present invention.
Figure 4B:
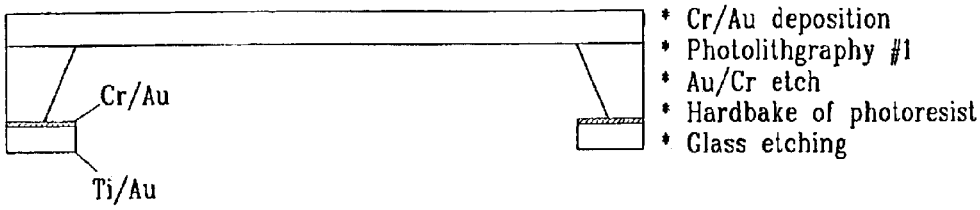
Figure 4C:
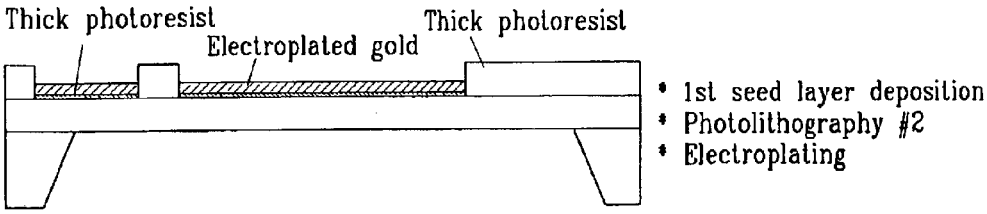
Figure 4D:
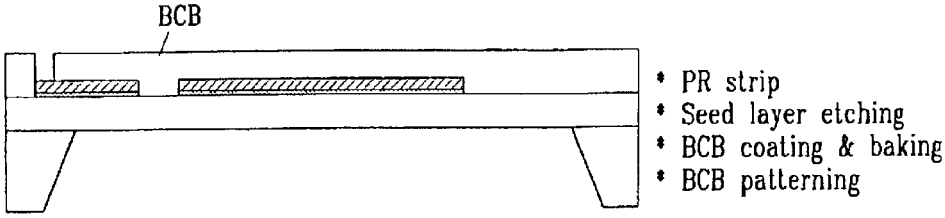
Figure 4E:
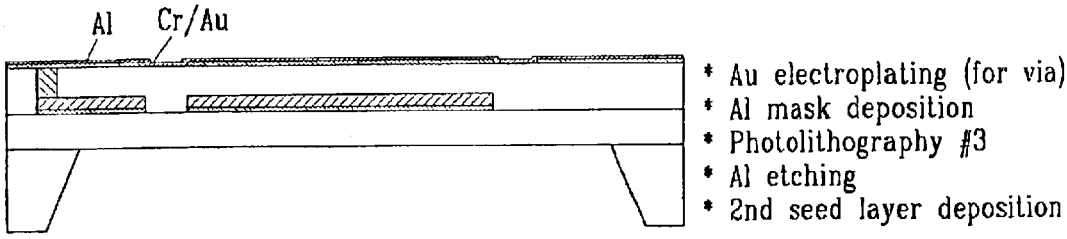
Figure 4F:
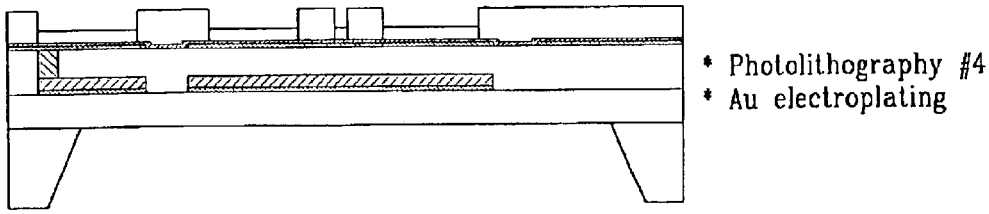
Figure 4G:
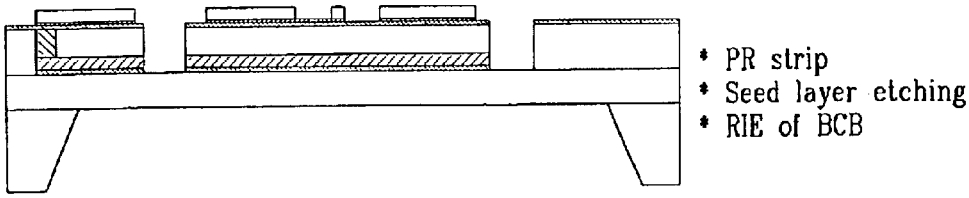
Figure 4H:
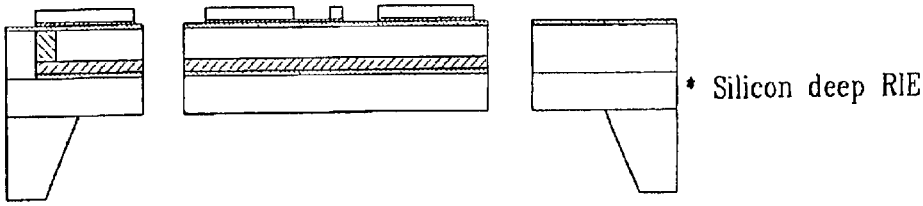

FIG. 3 shows a configuration of a mechanically moving beam steering antenna.

A silicon substrate is attached on a glass substrate, and a ground plane is provided on the silicon substrate. A dielectric polymer layer (e.g., a BCB hinge) is formed on the ground plane, and a microstrip line connected to the antennas is formed on the dielectric polymer layer. A magnetic stick of Ni is formed on the bottom surface of the silicon substrate.

The dielectric polymer layer includes a central platform, an internal frame and an external frame respectively surrounding the central platform, a pair of internal hinges for connecting the platform with the internal frame; and a pair of external hinges for connecting the internal frame with the external frame. A plurality of antennas is arranged on the platform, and the microstrip line connected to the antennas is formed on the internal hinge and the frame. Two pairs of polymer hinges are formed, and one pair of hinges provided opposite to each other with respect to a patch antenna functions as a single rotary shaft. That is, in the case where one pair of the internal hinges forms a rotary shaft for east-to-west rotations, the opposite pair of the external hinges forms a rotary shaft for south-north rotations. If the material of the hinges allows distortions of about almost 90 degrees, the antenna platform can steer the direction of the beams in all points in three-dimensional hemisphere space with respect to two rotary shafts.

The silicon substrate comprises a platform of the dielectric polymer layer; platform units respectively corresponding to the internal and external frames; an internal frame unit; and an external frame unit, and is combined with the dielectric polymer layer to be varied with the dielectric polymer layer.

One pair of magnetic sticks is formed on the silicon substrate's platform units, and another pair of the magnetic sticks is formed on the internal frame unit. The magnetic sticks formed on the platform units are formed in the direction parallel to that of the internal hinges, and the magnetic sticks formed on the internal frame unit are formed in the direction parallel to that of the external hinges.

The antenna uses a microstrip patch antenna structure. In this structure, it is more appropriate to use a microstrip feeding structure for the mechanically moving antenna. Basically, the dielectric is used for the microstrip line and the patch antenna is used for a moving antenna structure by processing the dielectric through the micro electro mechanical systems (MEMS) technique. To manufacture the antenna, the bulk and surface micromachining technique of the MEMS is compositely used, and FIG. 4 shows a corresponding manufacturing process.

To prevent loss to the substrates, an anodic bonding process is performed on high-resistive silicon with low electric loss and on a glass wafer so as to use the process-performed ones as a substrate, and a bulk micromachining technique is executed on them to obtain a space for mechanical rotation. The high-resistive silicon is processed to be thin to protect the mechanical deformation of the polymer dielectric. A ground line, polymer dielectric and a microstrip patch are sequentially formed on the front surface of the silicon substrate, and the ground line and the microstrip patch are manufactured through an electroplating method using a polymer mold. The polymer dielectric is manufactured into the form of an antenna through a plasma etching process, and penetration etching is performed on a predetermined portion of the silicon substrate needed for moving the structure. Accordingly, the antenna platform is separated from the substrate and becomes rotatable.

Figure 5:
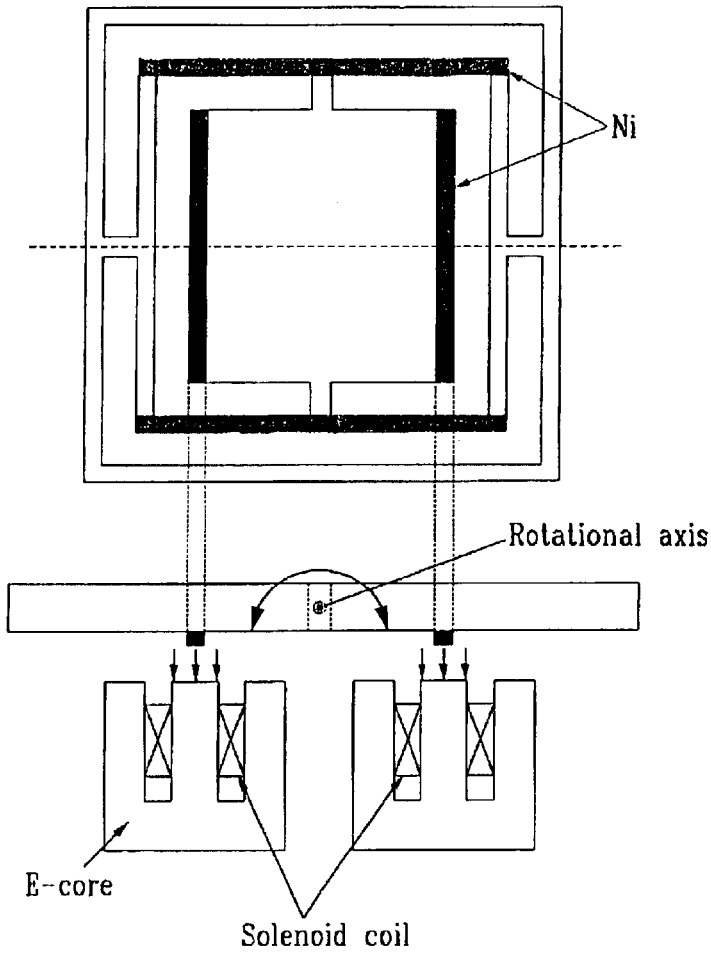
FIG. 5 shows an arrangement of a magnetic body for magnetically driving a mechanical beam steering antenna and a driving method according to a preferred embodiment of the present invention.

In order to enlarge beam-scanning ranges, the rotation of wide angles is needed. In general, in the case of electrostatic driving used in the MEMS structure, greater driving power is generated when the distance between a driving electrode and the structure becomes shorter, and in this instance, the movement of the structure is restricted according to contact with the electrode. To solve this problem in the present invention, a magnetic force driving method is used. For this, as shown in FIG. 4(*c*), the rear surface of the silicon substrate is electroplated with magnetic material such as nickel by using the electroplating method utilizing the polymer mold, and magnetic fields are provided from the bottom portion. FIG. 5 shows an arrangement of the magnetic material and a principle of rotation driving. As shown, when a uniform magnetic field is provided to the magnetic material from a solenoid coil, a force for magnetization vectors caused by magnetic anisotropy within the magnetic material to be arranged in parallel with the direction of the magnetic field is generated. This magnetic force generates a rotation torque according to the hinge structure so that the structure rotates with respect to the rotation axis in parallel to the hinge.

In the case where only the patch is moved, it is difficult to make a feeding structure having an appropriate impedance matching since the impedance is greatly varied, and hence, the dielectric under the patch must be concurrently moved. In this instance, to obtain a wide driving angle, the mechanical characteristics of the hinge structure are important, and by using the material of low elasticity such as the polymer dielectric for the hinge, distortion driving is easily obtained. By using the MEMS technique, it is possible to precisely process the above-described small structure, and fast mechanical responses are obtained through the minimization.

According to the present invention, by providing electrical phase differences to the respective antennas, the beams can be steered in the desired directions, and by mechanically moving the antenna in the desired direction, the performance of the antenna can be maximized regardless of the target's direction. By using this array antenna, a very effective system can be configured in the smart antenna. That is, when this antenna is used as a receiving antenna, because of its good efficiency, receiving performance can be improved regardless of the receiving angles in the case of using a transmitter that generates less power. Also, when this antenna is used as a transmitting antenna, full signals can be transmitted to desired directions regardless of the angles with less power.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An antenna device comprising:

a platform;

an antenna formed on a surface of the platform;

a first rotation shaft for enabling angular displacements of the antenna in the first direction;

a second rotation shaft for enabling angular displacements of the antenna in the second direction independent from the angular displacements of the antenna in the first direction;

an internal frame connected to the platform through the first rotation shaft;

an external frame connected to the platform through the second rotation shaft; and a ground plane formed on the surface of the platform opposite to the surface on which the antenna is formed, wherein the first and second rotation shafts, the platform, and the internal and external frames are made of dielectric material.

2. The antenna device of claim 1, further comprising:

a first conductive line connected to the antenna; and a second conductive line connected to the ground plane.

3. The antenna device of claim 2, further comprising a driver for mechanically displacing the platform and the internal frame using electromagnetic force.

4. The antenna device of claim 1, wherein the dielectric material comprises benzocyclobutene.

5. A method for manufacturing an antenna device comprising:

attaching a silicon substrate to a glass substrate;

processing the glass substrate to form a displacement space;

forming a ground plane on the silicon substrate;

forming a dielectric layer on the ground plane;

forming an antenna on the dielectric layer;

patterning the dielectric layer to form a platform, an internal frame, an external frame and a hinge; and patterning the silicon substrate to separate it into a platform unit, an internal frame unit and an external frame unit.

* * * * *